US005567190A

United States Patent [19]

Oates

[11] Patent Number: 5,567,190

[45] Date of Patent: Oct. 22, 1996

[54] VARIABLE ANGLE OF ATTACK FINBOX ASSEMBLY FOR SURFBOARDS AND THE LIKE

[76] Inventor: Kenneth W. Oates, 3915 Mission Blvd., San Diego, Calif. 92109

[21] Appl. No.: 446,419

[22] Filed: May 22, 1995

[51] Int. Cl.[6] ..... A63C 15/00

[52] U.S. Cl. ..... 441/79; 114/129

[58] Field of Search ..... 114/140, 126, 114/127, 128; 441/74, 75, 79

[56] References Cited

U.S. PATENT DOCUMENTS 3,308,493 3/1967 Lambach .
3,564,632 2/1971 Bahne ..... 441/79
3,890,661 6/1975 Johnson ..... 441/79
4,493,665 1/1985 Liddle .
4,733,496 3/1988 Wallner .
4,854,904 8/1989 Wahl ..... 441/79

*Primary Examiner*—Stephen Avila
*Attorney, Agent, or Firm*—George J. Rubens

[57] ABSTRACT

One or more variable angle fin box assemblies are sealed on the underside of a surfboard or the like that allows the angle of attack of the fin to be varied with the respect to the longitudinal axis of the surfboard, enabling the speed, stability and maneuvering characteristics of the surfboard to be adjusted or "tuned" by the rider in accordance with the rider's level of skill, different surf conditions and wave sizes. The novel fin box assembly has a longitudinal channel to receive the base end of a conventional surfboard fin, and in which a device is provided for securing the movable fin in the selected adjusted angular position.

20 Claims, 3 Drawing Sheets

VARIABLE ANGLE OF ATTACK FINBOX ASSEMBLY FOR SURFBOARDS AND THE LIKE

BACKGROUND OF THE INVENTION

This invention relates to surfboards, and more particularly to a variable angle fin and mounting box assembly for such boards which enables the rider to "tune" the the performance of the surfboard by adjusting the angular relation of a conventional fin with respect to the longitudinal axis of the board thereby changing its maneuvering characteristacs to adapt to the various existing surfing conditions. As used hereinafter the term "surfboard" includes surfboards, long and short boards, boogie boards, sailboards, and other similarly-hulled watercraft which are maneuvered by the riders shifting their weight on the hull.

The need for an adjustably-mounted fin on a surfboard has been recognized by the art for providing surfboard stability and variable maneuvering characteristics depending on wave conditions and the weight of the rider. Such conditions were recognized in U.S. Pat. No. 3,308,493 issued on Mar. 14, 1967 to Frederick A. Lambach. In this patent the single fin was made adjustable in a direction parallel to the longitudinal axis of the surfboard, primarily to accomodate riders of different weights and their locations on the boards. A similar construction is shown in U.S. Pat. No. 3,564,632 issued on Feb. 23, 1971 to a W. L. Bahne Jr.

It should be noted that in each of the above cited patents, the length of the finbox is much longer than the length of the fin base to permit its longitudinal movement. Furthermore these patented devices required the use of a specially designed fin.

U.S. Pat. No. 4,493,665 issued on Jan. 15, 1985 to Edward M. Liddle recognized the need to adjust the angle of the fin with respect to the longitudinal axis of the surfboard to suit the weight of the rider, level of skill, and surfing conditions. These objects were met by providing a pair of elongated curved fin boxes, one on each side of the surfboard, of a length much greater than the fin base for longitudinally adjusting the position of the fin on the board as well as varying the angle of attack, both simultaneously, which may adversely effect the design characteristics of the surfboard and complicate its "tuning" by the rider.

In U.S. Pat. No. 4,733,496 issued on Mar. 29, 1988 to Peter Wallner, a single rudder-type fin was designed to enhance maneuverability of the surfboard through a two-piece construction, namely a fixed forward section and an aft pivotal section rotabably therein with respect to the longitudinal axis of the surfboard.

In the above cited patented art, the fin box was necessarily constructed to be much longer than the fin base to allow adjustment, and the fin was of a special design to achieve the desired results. A larger fin box than the fin base provides a greater water drag coefficient.

OBJECTS OF THE INVENTION

A principal object of this invention is to provide a novel fin box for a surfboard that can accommodate a conventional surfboard fin, enabling the fin to be adjusted by the rider about a vertical axis, angularly with respect to the longitudinal axis or centerline of the board in which it is used and thereby "tuning" the maneuvering characteristics of the surfboard for optimum performance for various existing surf conditions.

By providing an adjustable fin box on each side of the board, each respective fin can be angularly adjusted independently of the other to account for the differences in the rider's stance with respect to the wave face. This would enable the rider, male or female, to adjust the fins to complement their strengths and to compensate for weakness in frontside or backside turning skill.

Another important object is to provide a fin box that will readily accomodate a plurality of conventional fins of different shapes and sizes that will allow the surfboard to be configured for different styles of riding complimented by different fin configurations. These configurations may vary, for example, from three fins of equal size, to two equally-sized side fins and a larger center fin, two equally-sized side fins minus the center fin, or one large center fin minus the two side fins.

A further object is to enable a fin box to be of minimum size and length to reduce the drag coefficient in the water while achieving the desired result.

Still further objects are to provide a finbox in which the angle of attack of the fin can be varied at its leading or trailing edge, or at an intermediate point of the fin, and to provide a fin box in which the angle of the fin can be adjusted infinitely and be readily ascertained, and which fin box is of a simple design and inexpensive to manufacture.

SUMMARY OF THE INVENTION

The present invention provides a novel surfboard fin box which detachably anchors a plurality of fin styles and sizes, which fins can be angularly adjusted with respect to the longitudinal axis, or centerline, of the surfboard, thereby enabling the adjustment of the angle of attack of the fin with respect to the water and enabling the speed, stability and maneuvering characteristics of the surfboard to be adjusted or "tuned" by the rider for different surf conditions and size, and to complement the position of the rider with respect to the wave face.

The novel fin box allows the angle of attack of the fin with respect to the water flow to be adjusted at either the leading or trailing edge or at both edges of the fin, to provide greater angular fin displacement.

DESCRIPTION OF THE PREFERRED EMBODIMENT

Figure 1:
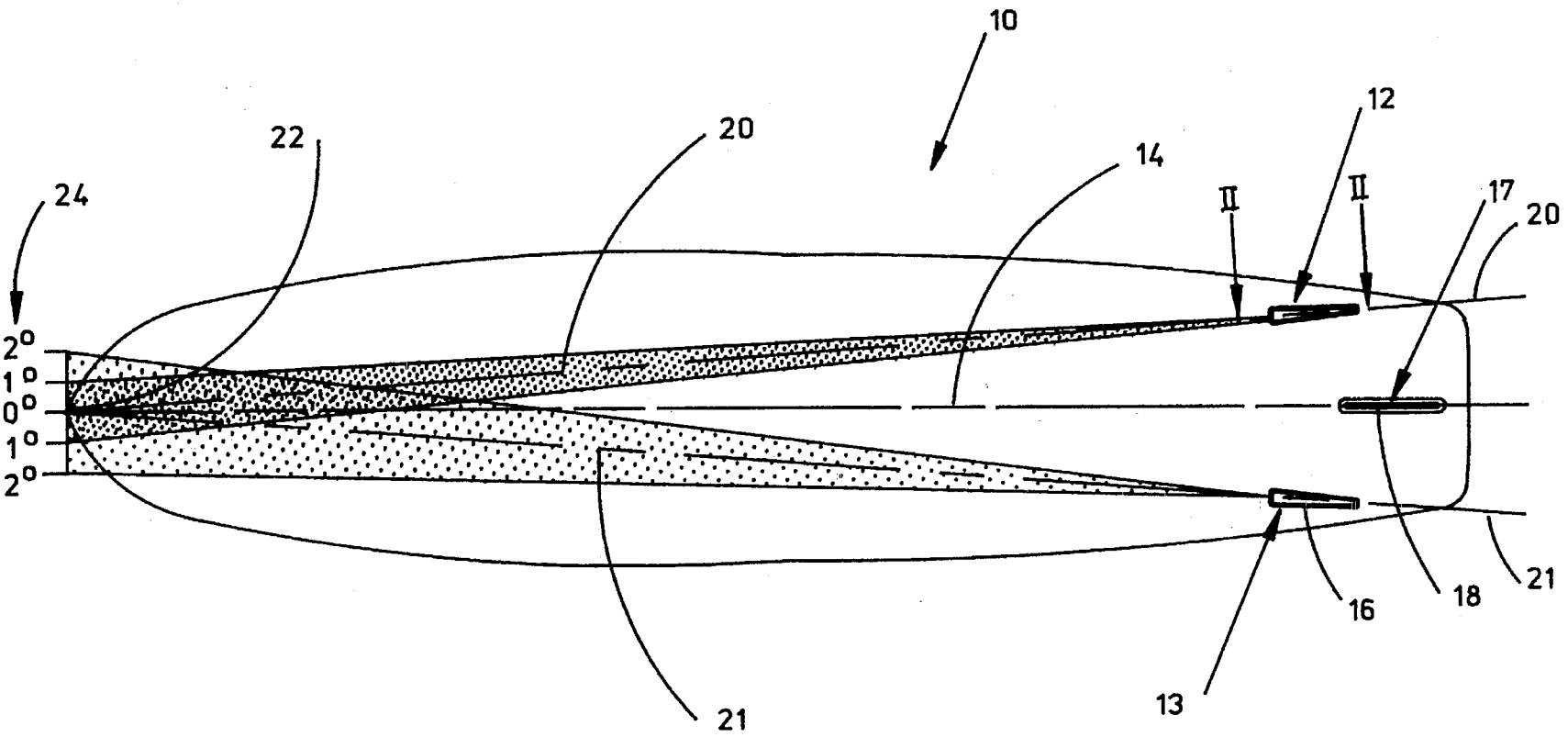
FIG. 1 is a bottom plan view of a typical surfboard showing the conventional surfboard having two novel fin box assemblies, one fin box on each side illustrating two different fin angle sweeps, and which may have a third central fin secured along the centerline of the surfboard.

Referring to the drawings where like reference numerals refer to similar parts throughout the figures, there is shown in FIG. 1 a bottom plan view of a conventional surfboard 10 having a pair of novel fin boxes 12 and 13, one on each side of the longitudinal centerline 14 of the surfboard. Each novel fin box is capable of supporting and anchoring a conventional fin 16. The surfboard may be provided with a conventional elongated third fin box 17 and associated fin 18 positioned along the surfboard centerline 14. Fin 18 may be of the type that is movable forward and aft in its elongated box along its centerline, as described in U.S. Pat. No. 3,564,632 previously described, and which forms no part of this invention. It is also possible that one of the novel fin boxes 12 or 13 and associated fin could be located along the centerline in lieu of finbox 17 (FIG. 1).

During the fabrication of the type of surfboard illustrated in FIG. 1, fin boxes 12 and 13 are normally secured in the surfboard by its fabricator with each respective centerline 20 and 21 of the respective fins intersecting the tip 22 of the nose of the surfboard as shown in FIG. 1, or aligned with the surfboard shaper's marks on the board.

The novelty of the present invention resides in the construction of finboxes 12 and 13 with means for enabling its associated respective fin to be angularly adjusted to either side of its centerline 20 & 21 with respect to the nose 22 of the surfboard. The amount of the displacement, or "fin angle variation" in one degree increments from the zero position at surfboard nose 22 is shown by phantom scale 24 in FIG. 1. By way of examples, two different "fin angle variations" are illustrated in FIG. 1, a total of four degree sweep (two degrees on each side of zero) is illustrated for fin box 13, while a total of two degree sweep (one side of each side of zero) is illustrated for fin box 12. Other degrees of sweep are available as will be later described.

The "fin angle variation" as measured in inches at nose 22 of the surfboard, depends on the width of the box opening, as will be later discussed, and the length of the surfboard, assuming the fin boxes will be embedded in each length board in the same relative position. The following table "A" shows the length of boards from a board 6' 6" in length to 11' in length and the estimated displacement in inches on each side of nose 22, assuming the fin box centerline 20–21 intersect surfboard nose 22, and for fin angle variations of 3 degrees (box width opening 0.625"); 3.5 degrees (box width opening 0.6875"); and 4 degrees (box width opening 0.750").

TABLE A

TYPICAL SURFBOARD FIN ANGLE VARIATIONS

| Fin box Opening: | .625" | .6875" | .750" |
|---|---|---|---|
| Total angle variation (degrees): | 3 | 3.5 | 4 |
| Total variation at surfboard nose: | | | |
| Board Length: | | | |

TABLE A-continued

TYPICAL SURFBOARD FIN ANGLE VARIATIONS

| | | | |
|---|---|---|---|
| 6' 6" | 4.08" | 4.77" | 5.45" |
| 7' 2" | 4.58" | 5.26" | 6.01" |
| 8' | 5.03" | 5.87" | 6.71" |
| 9' | 5.66" | 6.60" | 7.55" |
| 9'6" | 5.97" | 6.97" | 7.97" |
| 10' | 6.29" | 7.33" | 8.39" |
| 10' 6" | 6.60" | 7.70" | 8.81" |
| 11' | 6.92" | 8.07" | 9.23" |

Figure 2:
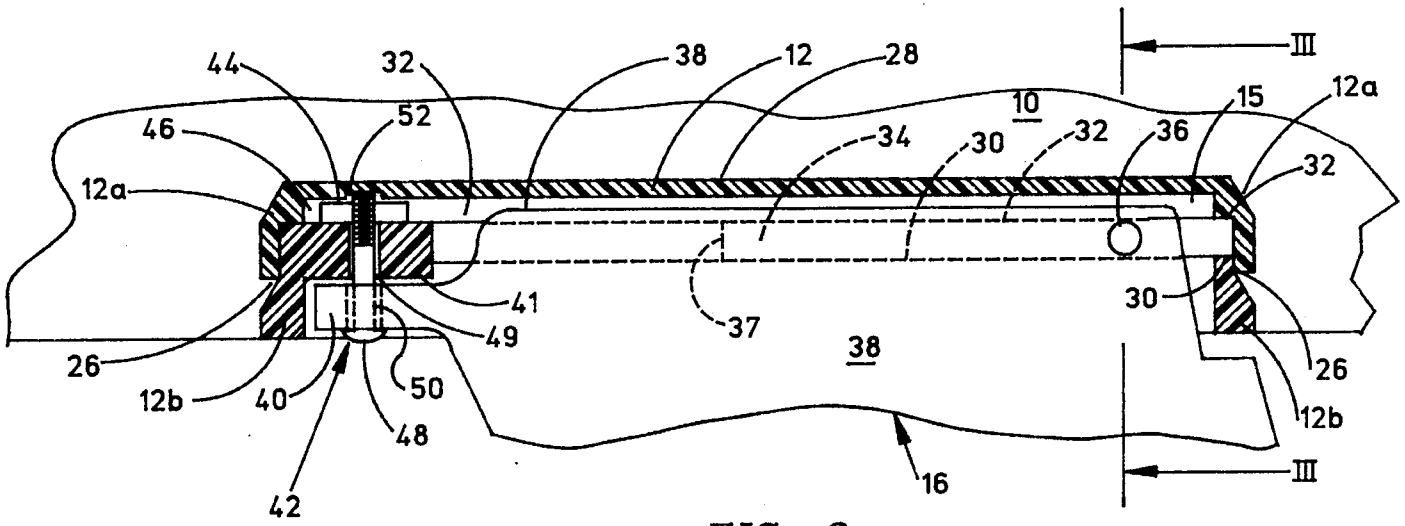
FIG. 2 is a partial longitudinal cross section of the surfboard and novel finbox of this invention, taken along line II—II of FIG. 1 and showing the angular fin adjustment means located at the forward end of the fin box.
Figure 3:
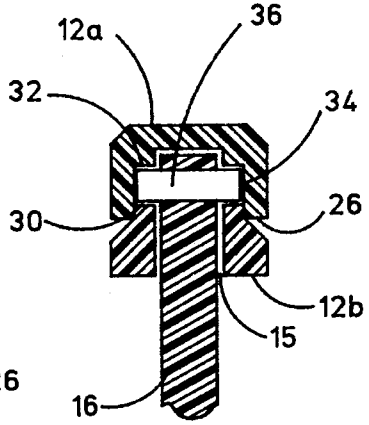
FIG. 3 is a cross-sectional view taken along line III—III of the fin box in FIG. 2 to show the fin anchoring pin and associated longitudinal slots to slidably support the fin anchoring pin.
Figure 4:
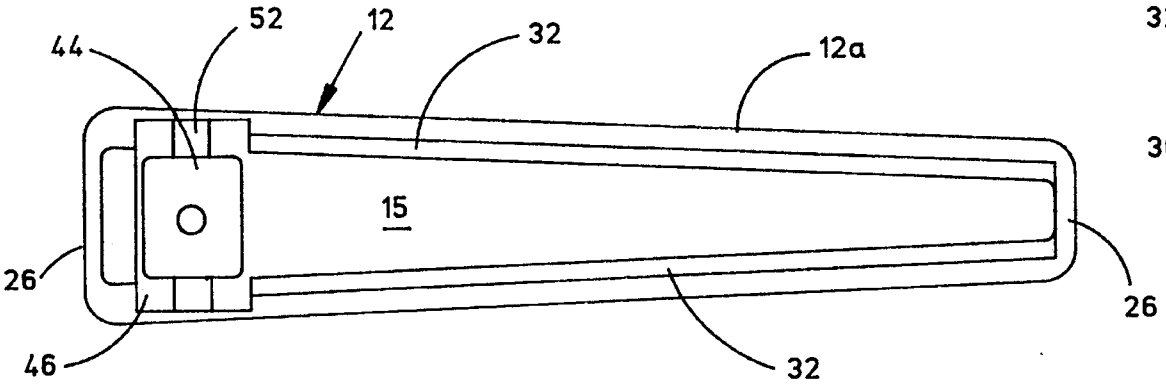
FIG. 4 is a bottom plan view of the upper half of the fin box of FIG. 2, showing the transverse slot slidably receiving the threaded plate of the adjustable clamping means.

The details of the novel invention are best shown in FIGS. 2–4 where a finbox 12, which is identical to finbox 13, is shown, fabricated of a suitable material, preferably in two halves, an upper half **12*a* and a lower half 12*b*, to facilitate molding or machining, whichever process is found to be most practical. After fabrication, box halves 12*a* and 12*b*** can be suitably cemented or otherwise joined together along their mating surfaces to form a strong integral body.

As shown in FIG. 2, fin box halves **12*a* and 12*b* are each formed with a mating closed-end vertical channel 15 to house and support the base end of a fin 16. Fin box halves 12*a* and 12*b* are fabricated to jointly form an adjoining peripheral external recess 26 which enables fin box 12 to be seated and cememted within a recessed bottom opening 28** in the surfboard.

As shown in FIG. 2, fin box 12 is mounted in flush relation with the bottom surface of the surfboard, minimizing the presence of fin box 12, thereby reducing drag as the board moves through the water.

As shown in FIGS. 2–4, lower box half **12*b* is formed with a longitudinal tapered internal shoulder 30 on each side of channel 15 that together with a peripheral shoulder 32 on upper box half 12*a*, to forms a slot 34 slidably to receive a pin 36, or other like anchoring device, of fin 16. As is well known in the art, pin 16 is first inserted into slot 34 at its entrance 37 with the forward end of the fin box tilted upward and thereafter slid aft until the base end 38 of the fin is snugly seated in the fin box channel 15**.

It should be noted that in the species of the invention shown in FIGS. 1–5, each fin box is fabricated in a tapered configuration, with the forward end of the fin box as well as its channel 15 being larger in width than the aft end. In this construction, the narrow aft end of the fin box acts as a fulcrum for the fin which enables the forward end of the fin to pivot, with the forward lug 40 of the fin base movable laterally within the enlarged forward end of the channel 15. It should be noted that the narrow, or fulcrum end of the fin box can be positioned facing either the forward or aft end of the surfboard.

With the aft end of fin 16 being pivotal, as in FIGS. 1–5, the the forward end of the fin is free to move laterally within channel 15 and with lug 40 movable in slot 41 in lower half **12*b*. Thus the centerline of the fin is movable about a vertical axis changing its angular orientation with respect to the centerline 14** of the surfboard, which is the very essence of the objects of this invention.

A clamping means 42 is provided for securing fin lug 40 in the rider's selected angular position within the enlarged channel opening 15. Clamping means 42 compresses a flat threaded plate 44 slidable in a transverse slot 46 formed between the upper and lower fin box halves. Slot 46 extends almost the entire width of the forward enlarged end of the fin box to enable plate 44 to have sufficient lateral movement in the fin box to provide the desired angular fin displacement, ie. the 4 degree displacement illustrated in FIG. 5. A clamping bolt 48 extends freely through a drilled opening 50 in lug end 40 and through a transverse slot 49 in the forward end of 12*b*, with its end threaded through slidable plate 44. Tightening bolt 48 clamps plate 44 to fin box lower half 12*b* in the selected angular displacement of the fin. It should be noted that plate 44 is sufficiently smaller in width than slot 46 to adjust for the fixed length of fin base end 38 as it pivots.

Figure 5:
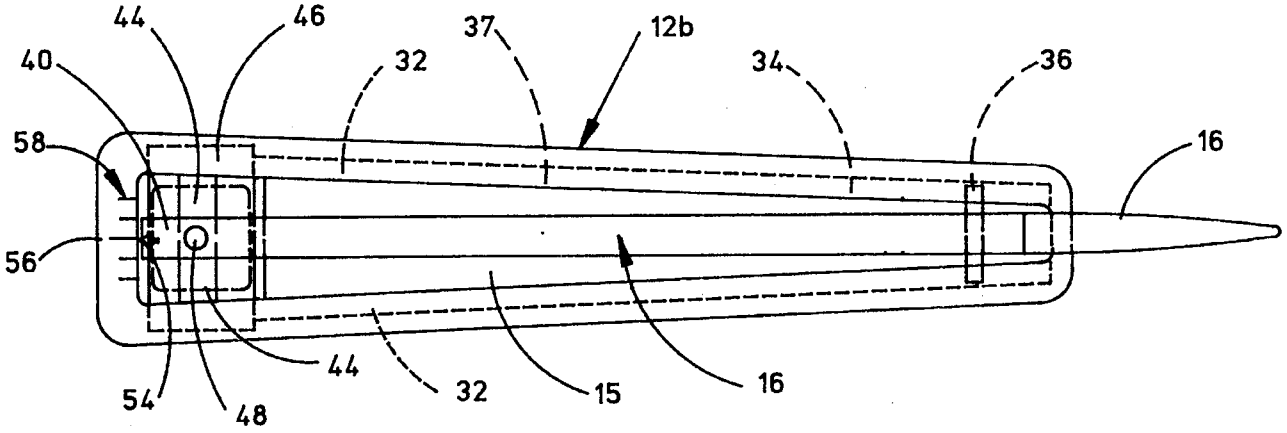
FIG. 5 is the bottom plan view of the lower half of the finbox of FIG. 2 with the fin installed showing the scale in degrees for indicating the selected angular positon of the fin within the fin box.

FIG. 5 shows the bottom plan view of lower fin box half 12*b* with its fin 16 installed in position within the fin box in its neutral position. Fin lug 40 has a pointer 54 positioned at the zero indicia 56 of scale 58 on the bottom face of fin box lower half 12*b*. In this zero position, the centerline 20 of fin 16 (FIG. 1) intersects the tip of nose 22 of surfboard 10 at the zero position on the phantom scale 24. In FIG. 5 each indicia 56 on both sides of the zero position of scale 58 is shown for purposes of illustration, to represent a one degree displacement of centerline 20 or a total of 2 degrees on either side of center of surfboard nose tip 22 FIG. 1 with the "nose angle variation" measured in inches as shown on Chart "A".

Figure 6:
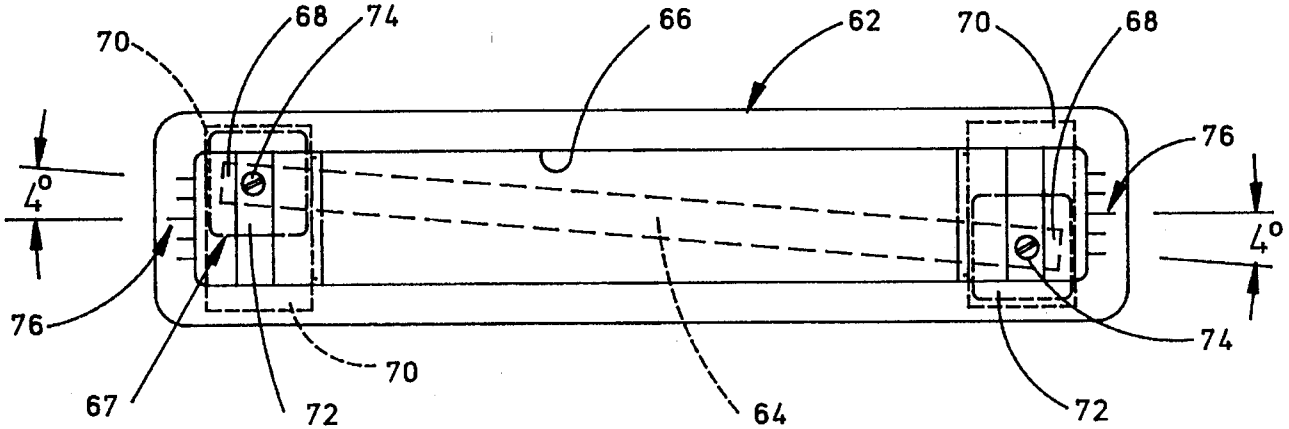
FIG. 6 is a modified finbox and fin having an angular adjusting means at both ends of a fin box, with the fin shown in only one possible angular position with respect to the fin box and to the nose of the surfboard.

FIG. 6 illustrates a modified fin box assembly 62 that is rectangular in configuration, as distinguished from the tapered configuration in FIGS. 1 & 5. Instead of pivoting the surfboard fin base 38 at the narrow end of fin box 12 and 13 as shown in FIGS. 1 & 5, a different configuration of fin base 64 in FIG. 6 (shown in broken lines) can be pivotted around any intermediate position within fin box channel 66. This fin adjustment is accomplished by providing both ends of the fin base 64 with a clamping means 67, such as 42 as shown in FIGS. 1 & 5. In FIG. 6 fin base 64 is provided with a projecting lug 68 at both ends, each similar to single lug 40 in FIGS. 1–5. Each end of fin box 62 is fabricated with a transverse slot 70 loosely to receive a slidable plate 72 intermediately threaded to receive a clamping bolt 74. Each end of the fin box is marked with a scale 76, for indicating the angular displacement of the fin on either side of the centerline 20 or 21 (FIG. 1) to the nose 22 of the surfboard. Because fin base 64 can be pivoted around its intermediate point, the fin can be angularly displaced twice as much as the fin in the species shown in FIGS. 1–5, that is 4 degrees on each side of the centerline each indicia representing a two degree displacement compared to the 2 degree displacement shown in FIGS. 1–5. If it is desired to maintain a maximum 2 degree displacement, the width of fin box 62 could be made smaller. In any event, the fin box 62 provides a greater opportunity for the rider to experiment in varying the angular displacement between the respective fins in each fin box.

The present invention provides a unique variable angle fin box that enables the surfboard rider to tune the surfboard performance by adjusting the angular relationship of the centerlines of the fins with respect to the nose of the surfboard. In this manner the rider can control the maneuverability of the surfboard depending on the various surf conditions, the length of the surfboard and, in particular, to the orientation of the rider with respect to the wave face, that is, whether the the rider is facing or has his back to the wave face-riding to his strong side/weak side, front side or back side.

I claim:

1. A variable angle fin and fin mounting box assembly for surfboards and other like boards comprising:

a longitudinal fin box capable of being embedded fixedly in the underside of said surf board;

said fin box having a vertical, longitudinally-extending closed-end channel to receive and house a base end of a fin;

means in said box for angularly adjusting said fin within the fin box about a vertical centerline with respect to the longitudinal axis of the board to change the angle of attack of the fin to the water flow, and means for securing said fin in the fin box in a selected fixed angular position.

2. The assembly of claim 1 wherein said adjusting means provides for angularly pivoting said fin within the fin box at least one end of said fin box.

3. The assembly of claim 2 wherein said channel has a tapered configuration with a larger end and a smaller end.

4. The assembly of claim 3 wherein the pivotal means is provided at the aft end of the fin box.

5. The assembly of claim 2 wherein the pivotal means is provided at the forward end of the fin box.

6. The assembly of claim 3 wherein the smaller end of the channel functions as the pivotal means.

7. The assembly of claim 1 wherein the angularly adjusting means is provided at the both ends of the fin box.

8. The assembly of claim 3 wherein the base end of the fin has a projection, and said fin box at the larger end of the channel has a shoulder on which said fin projection is slidably supported.

9. The assembly of claim 1 wherein the base end of the fin has a projection at its forward and aft ends and said fin box at both ends has a shoulder for slidably supporting both projections.

10. The assembly of claims 8 or 9 wherein a clamping means is provided for securing said fin projection in the selected angular on said shoulder.

11. The assembly of claim 1 wherein a bottom face of said fin box has demarcations in degrees to indicate the angular position of the fin with respect to the longitudinal axis of the board.

12. The assembly of claim 1 wherein the outer peripheral sides of the box have a longitudinal groove for anchoring the box in the board when sealed in place therein.

13. The assembly of claim 9 wherein an angular adjusting means for said fin is provided at both ends of said fin box.

14. A variable angle fin and fin mounting box assembly for surfboards and other like boards comprising:

a longitudinal fin box capable of being embedded fixedly in the underside of said surfboard;

said fin box having a longitudinal vertically-extending closed-end channel opening to receive and house a base end of a fin;

means in at least one end of the fin box for angularly pivoting said fin about a vertical axis in a fixed selected position with respect to the longitudinal axis of the surfboard to change the angle of attack of the fin to the waterflow;

means on the fin box for indicating the selected angular displacement of the fin;

means for securing said fin in the selected angular position.

15. The assembly of claim 14 wherein said channel is tapered having the larger end opening and a smaller end, said smaller end providing a means for pivoting said fin, the larger end of said channel having the means for securing said fin in the selected angular position.

16. The assembly of claim 14 wherein said channel is rectangular in configuration with both ends of the fin base being free to move laterally within the channel, and fin securing means at both ends of said fin box.

17. A variable angle fin and fin mounting box assembly for surfboards and other like boards comprising:

a longitudinal fin box capable of being embedded in the underside of said surfboard;

said fin box being fabricated in two mating halves and secured together;

said fin box halves having a vertical longitudinally-extended closed-end channel opening to receive and house a base end of a fin;

means in at least one end of the fin box for angularly adjusting said fin about a vertical axis with respect to the longitudinal axis of the surfboard to change the angle of attack of the fin to the water flow;

means for securing said fin in the selected angular position;

said means including a plate slidable in a transverse slot in one end of said fin box and a bolt for clamping said slidable plate to the fin box in the selected angular position; and indicia means on the fin box for indicating the selected angular position of the fin.

18. A surfboard and other like boards having a variable angle fin and fin mounting box assembly comprising;

said fin box being embedded fixedly in the underside of said surfboard;

said fin box having a longitudinal vertically extending closed end channel opening to receive and house a base end of the fin;

means in at least one end of the fin box for angularly adjusting said fin about a vertical axis and in a fixed selected position within said channel with respect to the longitudinal centerline of the surfboard for changing the angle of attack of the fin to the water flow;

means for securing said fin within the fin box in the selected angular fixed position; and means for indicating the selected angular position of the fin within the fin box.

19. The surfboard of claim 18 wherein fin adjusting and securing means are provided at both ends of the fin box.

20. The surfboard of claim 18 wherein two variable angle fin and fin mounting box assemblies are provided, one embedded on each side of the longitudinal centerline of the surfboard and oriented with respect thereto.

* * * * *